United States Patent [19]

Kreth et al.

[11] Patent Number: 4,688,600

[45] Date of Patent: Aug. 25, 1987

[54] MULTIWAY VALVE WITH PRESSURE BALANCE

[75] Inventors: Norbert Kreth, Lohr-Sendelbach; Peter Buttner; Armin Stellwagen, both of Lohr/Main, all of Fed. Rep. of Germany

[73] Assignee: Mannesmann Rexroth GmbH, Fed. Rep. of Germany

[21] Appl. No.: 833,365

[22] Filed: Feb. 25, 1986

[30] Foreign Application Priority Data

Feb. 28, 1985 [DE] Fed. Rep. of Germany ..... 3507121

[51] Int. Cl.[4] ..... F15B 13/02

[52] U.S. Cl. ..... 137/596; 91/446; 137/596.13

[58] Field of Search ..... 91/446; 137/596, 596.13

[56] References Cited

U.S. PATENT DOCUMENTS

| | | | |
|---|---|---|---|
| 3,970,108 | 7/1976 | Ailshie | 137/596.13 |
| 4,003,400 | 1/1977 | Turner | 137/596 |
| 4,154,262 | 5/1979 | Blume et al. | 91/446 X |
| 4,253,482 | 3/1981 | Stephens | 137/596.13 X |
| 4,352,375 | 10/1982 | Williams | 137/596.13 |
| 4,361,169 | 11/1982 | Williams | 137/596.13 |

*Primary Examiner*—Gerald A. Michalsky

*Attorney, Agent, or Firm*—Harness, Dickey & Pierce

[57] ABSTRACT

Into the housing of a multiway valve a pressure balance is incorporated, the end of the control piston subjected to the load report pressure facing a housing recess in which the load report pressure obtains while the opposite end of the control piston is subjected to the supply pressure and in the opposite sense to the supply pressure to the force of a spring. The valve has a simple structure.

10 Claims, 3 Drawing Figures

MULTIWAY VALVE WITH PRESSURE BALANCE

BACKGROUND OF THE INVENTION

The invention relates to a multiway valve with pressure balance having the features set forth in the preamble of claim 1.

Such a multiway valve is known and is made by Mannesmann Rexroth GmbH with type designation SP12. In the transverse bore of the valve housing a load retaining valve is disposed with adjustable throttle. With the throttle the throughflow, in particular the maximum volume flow, can be adjusted. The multiway valve can be provided on the input side with a pressue balance which keeps the pressure difference across the multiway valve constant. The housing of the pressure balance is attached to the multiway valve.

It is also known to insert a pressure balance into the transverse bore provided in the valve housing of the multiway valve. The fluid supply is through a single passage in the valve centre which is followed on either side by a load report or pickup passage, a passage leading to the consumer and a passage connected to the tank, in this order. The control piston of the pressure balance is subjected to the pressure in the centre housing recess of the valve in the closure direction. The load report or pickup pressure is conducted via a housing bore into the spring chamber of the pressure balance. The known pressure balance also has a load retaining function.

The problem underlying the invention is to provide the multiway valve of the type outlined at the beginning with a pressure balance which is built into the valve housing and has the simplest possible form.

SUMMARY OF THE INVENTION

This problem is solved by the features set forth in the characterizing clause of claim 1.

In the multiway valve according to the invention no special precautions need be taken to conduct the load report pressure to the control piston of the pressure balance because the control piston portion subjected to the load report or status pressure directly faces the housing recess in which the load report pressure obtains. Since the spring must act on the control piston in the same sense as the load report pressure and is disposed in the cavity of the closure screw in which the valve supply pressure acts on the control piston, the spring bears on an extension of the control piston so that the force of the spring can act in the opposite sense to the supply pressure on the control piston. The overall result is a relatively simple structure of the pressure balance in the valve housing. The pressure balance also has a volume flow limitation.

BRIEF DESCRIPTION OF THE DRAWINGS

Examples of embodiment of the invention will be explained in detail hereinafter with the aid of the drawings, wherein.

DETAILED DESCRIPTION OF THE PREFERRED EMBODIMENTS OF THE INVENTION

Figure 1:
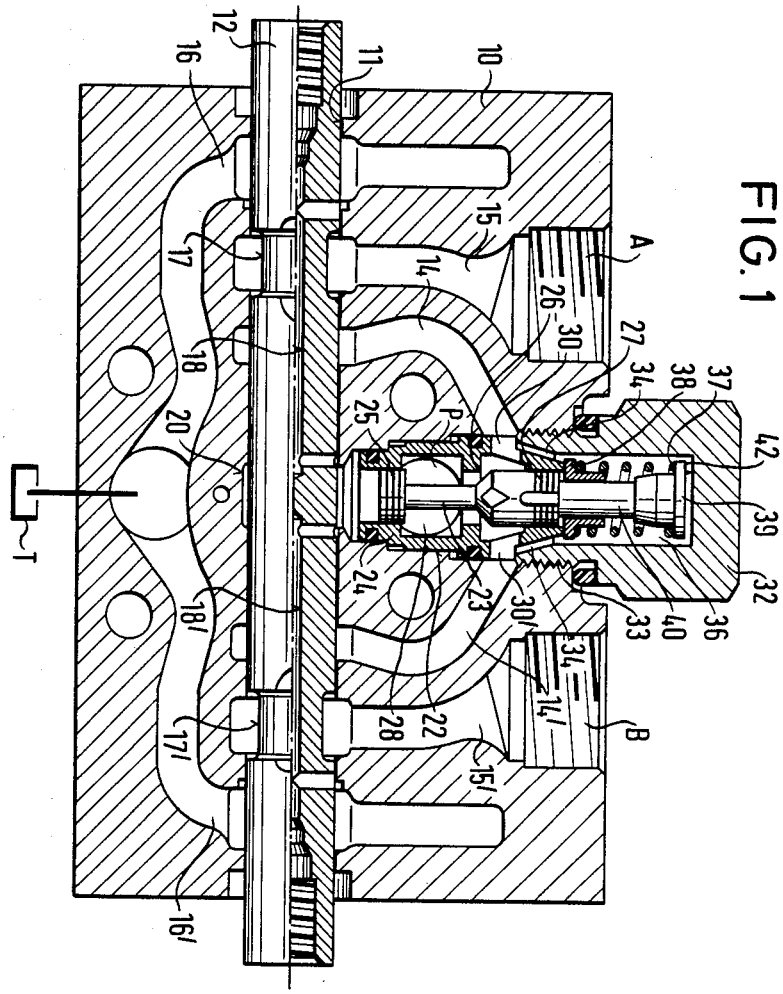
FIG. 1 is a section through a multiway valve with pressure balance in a first embodiment.

In a bore 11 of the valve housing 10 a valve slide piston 12 is displaceably arranged. Opening into the bore 11, originating from the valve centre, on both sides in this order are an admission passage 14, 14', a working passage 15, 15' leading to the connections A and B for a double acting hydraulic cylinder and a passage 16, 16' connected to the tank. If the valve piston 12 is displaced out of the centre position illustrated to the right or left into a working position via in each case an annular groove 17, 17' one of the admission passages 14 or 14' is connected to a working passage 15 or 15' whilst the other working passage is connected to the passage 16 or 16' leading to the tank.

The load pressure acting at the particular consumer, depending on the working position of the valve piston 12 in the working passage 15 or 15' is tapped off via a load report passage 18 or 18' which is arranged in the valve piston 12. The two load report passages open in the valve centre into an annular housing recess 20 in which in each operating position of the valve piston the load pressure thus obtains. Now, the known multiway valve comprises a bore via which the annular housing recess 20 is connected to a pressure balance located outside the valve housing.

It is apparent from FIG. 1 that the pressure balance is disposed in a bore 22 provided transversely of the longitudinal bore 11 in the valve housing 10. A control piston 23 is displaceably arranged in the valve sleeve 24 which is inserted in the bore 22 provided with corresponding stop shoulders and seals. The bore 22 extends up to the annular housing recess 20 in which the load report pressure obtains. In this manner the portion 25 of the control piston 22 facing the recess 20 is subjected to the load report pressure. The valve sleeve 24 comprises a control edge 26 with which a control piston portion 27 cooperates by which the flow cross-section of the fluid connection 28 coming from a fluid source P within the valve sleeve 24 to the admission passages 14 and 14' is adjustable. For the admission of fluid to the passages 14 and 14' respectively the sleeve 24 has corresponding lateral openings 30 and 30'. The valve sleeve 24 is held by a closure screw 32 in the bore 22. The closure screw 32 is screwed into a thread 33 of the bore. The sleeve 24 comprises passages 34 via which fluid can flow into the admission passages 14 and 14' into a spring chamber 36 formed in the closure screw 32. Arranged in the spring chamber 36 is a spring 37 which bears on the one hand on an annular member 38 which rests on the upper end side of the sleeve 24 and which on the other hand bears on a flange 39 of a rod-shaped extension 40 which is fixedly connected to the control piston portion 27. The spring 37 thus acts in the same sense as the load report pressure on the control piston 23 whilst the supply pressure in the spring chamber 36 acts in the opposite sense on the control piston.

The greatest possible flow cross-section between the control piston portion 27 and the control edge 26 for the fluid results from the engagement of the flange 39 on the bottom 42 of the closure screw. The function of the pressure balance is known. If the load pressure at the consumer increases, via the control piston portion 27 the fluid flow into the corresponding admission passage 14 or 14' is increased so that in spite of the different load at the consumer the working speed of the consumer remains constant.

Figure 2:
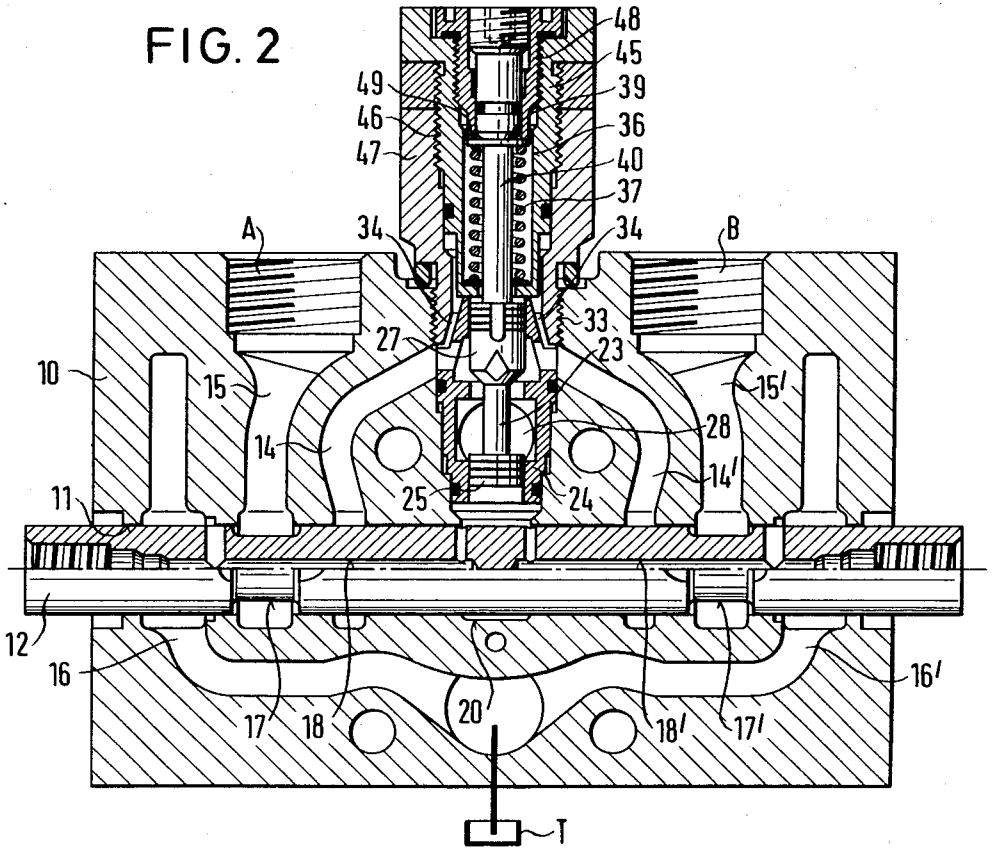
FIG. 2 is a section through a multiway valve with pressure balance in which the spring is adjustably disposed and FIG. 3 is a section through a multiway valve with pessure balance in which an additional volume flow limitation for the fluid supply is adjustably arranged.

FIG. 2 illustrates a modified embodiment, the spring being adjustable. Identical components are provided with the same reference numerals as in FIG. 1.

The difference compared with FIG. 1 is that the spring 37 is supported on the housing side at an adjusting bush 45 which is screwed at 46 to the closure screw 47. By turning the adjusting bush 45 in the closure screw 47 it is therefore possible to adjust the spring tension.

The limit stop for the maximum opening of the pressure balance is an insert 48 which is screwed into the adjusting bush 45 and at the end side 49 of which the flange 39 engages the extension 40 of the control piston 23. In this embodiment as well the spring chamber 36 within the adjusting bush 45 and the space between the flange 39 and the insert 48 is connected via passages 34 to the admission passages 14 and 14'.

Figure 3:
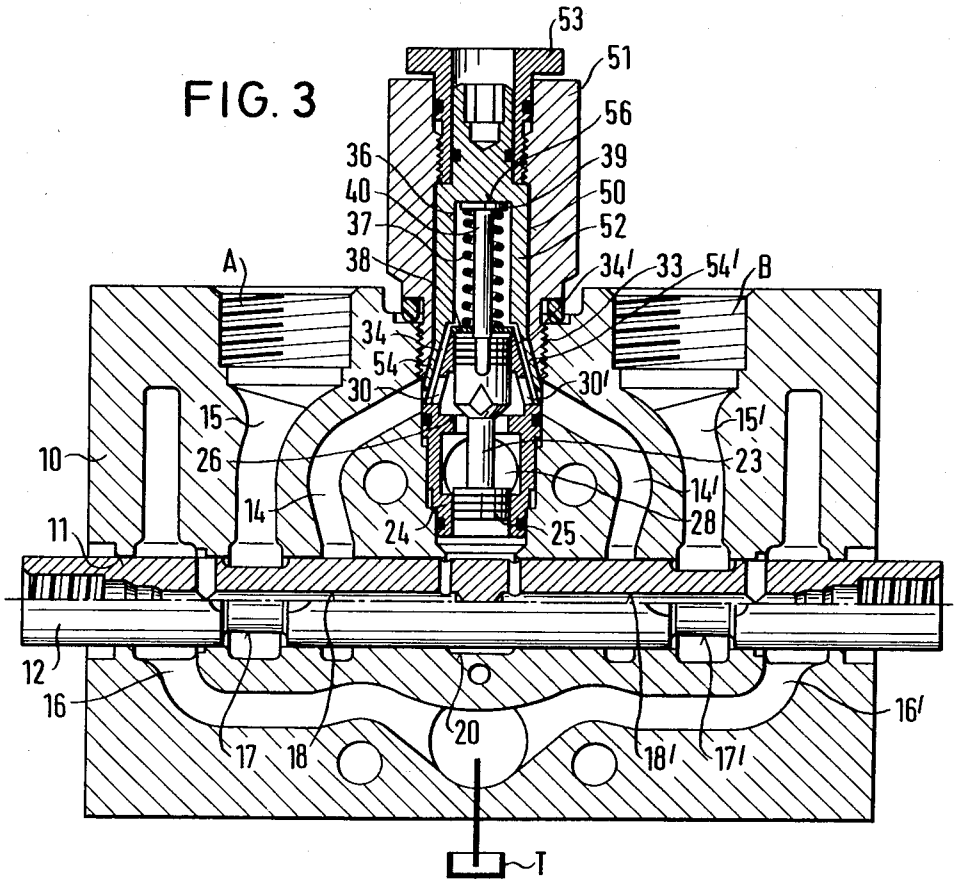

In the embodiment of FIG. 3, in which identical components also bear the same reference numerals, in a bore 50 of the closure screw 51 a sleeve 52 is displaceably disposed in which the spring chamber 36 is formed. The sleeve 52 is held by a screw 53 in the bore 50. The sleeve 52 is provided on both sides with projecting tongues 54 and 54' which extend between the closure screw 51 screwed at 33 to the valve housing 10 and the valve sleeve 24 into the latter openings 30 and 30' of the valve sleeve 24 and are so formed that by turning the sleeve 52 the flow cross-section for the fluid can be adjusted downstream of the control edge 26 in the respective admission passage 14 or 14'. Thus, the throttle cross-section defined by the control piston 23 is followed by the throttle cross-section adjustable by the sleeve 52.

In this embodiment as well the spring chamber 36 is subjected via pasages 34 and 34' opening into the admission passages 14 and 14' on the admission pressure to the valve piston 12. The stop fixed with respect to the housing for the spring 37 is formed by an annular member 38 which rests on the end face of the valve sleeve 24. The flange 39 provided at the extension 40 of the control piston 23 for supporting the other end of the spring can come to bear on the bottom 56 of the sleeve 52 to limit the opening of the control piston.

All the multiway valves illustrated serve to actuate a double acting hydraulic cylinder. The multiway valve may however also be used to actuate a single acting cylinder. In this case only one working passage 15 is provided which in accordance with the position of the valve piston 12 is connected to the admission passage 14 or to the tank whilst the other passages in the housing are dispensed with.

We claim:

1. Multiway valve with a pressure balance for controlling the fluid communication between a consumer and a fluid source or a tank comprising a control piston displaceably arranged in a longitudinal bore of a valve housing, said valve housing being formed with an admission passage for fluid, a working passage connected to the consumer and a discharge passage connected to the tank open into said valve housing longitudinal bore, a load pressure passage formed in said control piston communicating with the working passage carrying the fluid to the consumer and which opens into a central recess of said valve housing, said valve housing being provided with a transverse bore extending transversely to said longitudinal bore, a valve in said transverse bore for connecting said fluid source to said admission passage, and said valve provides for load pressure compensation of the consumer comprising a control piston subjected in one direction to the pressure in the admission passage and in the opposite sense to a spring and said load pressure and which adjusts the flow cross-section between said fluid source and said admission passage, characterized in that said transverse bore in the valve housing opens into said valve housing recess communicating with said load pressure passage said valve piston and said control piston portion being received in the recess, said pressure balance being subjected directly to said load pressure, and said spring being arranged in a valve chamber subjected to the pressure in the admission passage between a stop and an extension of said control piston so that said spring acts in the same sense as said load pressure on the control piston.

2. Multiway valve according to claim 1, characterized in that the piston portion of the control piston subjected to the load pressure is guided in a sleeve inserted in the transverse bore and into which the fluid connection opens and which comprises a control edge cooperating with the control piston portion setting the flow cross-section to the admission passage said sleeve comprising at least one opening opening into said admission passage.

3. Multiway valve according to claim 2, characterized in that the valve sleeve is held in the transverse bore by a closure screw screwed to said valve housing transverse bore.

4. Multiway valve according to claim 3, characterized in that the spring chamber is formed in the closure screw.

5. Multiway valve according to claim 3, characterized in that an extension of the control piston supports the spring is adapted in the opening direction of the pressure balance to be engaged at the bottom of the closure screw.

6. Multiway valve according to claim 3, characterized in that the stop fixed with respect to the housing for the spring is an adjustable adjusting bush screwed to the closure screw and a bottom stop for the extension of the control piston comprising an insert screwed into said adjusting bush.

7. Multiway valve according to claim 3, characterized in that a sleeve is disposed in a bore of the closure screw, said sleeve cooperating with the admission passage to define the effective flow cross-section into the admission passage by adjustment of the sleeve in the rotation direction.

8. Multiway valve according to claim 7, characterized in that the spring chamber is formed in the sleeve and the sleeve is held between an adjusting bush screwed to the closure screw and the extension of the control piston supporting the spring.

9. Multiway valve according to claim 2, characterized in that passages are provided for connecting the admission passage to the spring chamber.

10. Multiway valve according to claim 1, characterized in that the stop fixed with respect to the housing for the spring is an annular member engaging the valve sleeve.

* * * * *